United States Patent [19]

Ahlstone et al.

[11] 3,937,251

[45] Feb. 10, 1976

[54] FLUID PRESSURE OPERATED SHUT OFF VALVE APPARATUS

[75] Inventors: Arthur G. Ahlstone, Ventura; Josef A. Bartos, Villa Park, both of Calif.

[73] Assignee: Vetco Offshore Industries, Inc., Ventura, Calif.

[22] Filed: July 29, 1974

[21] Appl. No.: 492,402

Related U.S. Application Data

[62] Division of Ser. No. 194,187, Nov. 1, 1971, Pat. No. 3,850,237.

[52] U.S. Cl. ..... 137/594; 251/57; 251/62; 251/31

[51] Int. Cl.[2] ..... F16K 31/143

[58] Field of Search ..... 251/57, 31, 62; 137/594

[56] References Cited

UNITED STATES PATENTS

| | | | |
|---|---|---|---|
| 3,604,679 | 9/1971 | Pennington | 251/31 X |
| 3,633,608 | 1/1972 | Minkner | 251/57 X |
| 3,635,436 | 1/1972 | Tillman | 251/31 |
| 3,646,962 | 3/1972 | Jones | 137/594 |

*Primary Examiner*—Arnold Rosenthal
*Attorney, Agent, or Firm*—Bernard Kriegel

[57] ABSTRACT

Emergency shutoff valve apparatus, including a gate valve assembly actuated to a closed position by fluid pressure acting on an actuator piston, such actuation causing the piston to exert a force through a liquid medium on a power piston to store energy in a spring device or other energy storing means. Relieving of the fluid pressure acting on the piston causes the energy storing means to act through the power piston and liquid medium to shift the actuator piston to a position closing the gate valve assembly. The gate valve assembly can also be shifted to a closed position by supplemental fluid pressure acting on the power piston or on an override piston.

9 Claims, 12 Drawing Figures

12
P
11
I
I
11
2
10
M
W
2
C 207c
78
235
207b
185a
231
184a
234
181a
233
77
230
207a
11

FLUID PRESSURE OPERATED SHUT OFF VALVE APPARATUS

This is a division, of application Ser. No. 194,187, filed Nov. 1, 1971, now patent No. 3,850,237.

In the drilling and production of wells, such as oil and/or gas wells, from locations offshore, the wells may be drilled, completed and produced from a platform at the surface of the water and through subsurface equipment located at the mudline at the bottom of the water.

From time-to-time, accidents may occur resulting in fire or substantial oil spillage or loss of production fluid into the water. To combat such losses of production fluid and consequential damage, various valve devices have been incorporated in the well tubing or in the casing below the mudline, which are adapted to automatically close in the event of damage to the equipment at the top of the water. Such subsurface shutoff valves are generally held open by fluid pressure supplied through control fluid conduits extending into the well from the platform. The use of such valves has heretofore posed problems due to the valves being unreliable and inoperative when needed.

A more reliable means of shutoff at the mudline has involved the use of a conventional christmas tree assembly at the subsurface. The subsurface christmas tree has been attached to the usual subsurface wellhead equipment and includes gate valves having an actuator automatically operable to close the gate valve in an emergency or when desired. However, such subsurface christmas trees are not susceptible of installation within the well or casing extension, and, therefore, are exposed to the underwater environment.

The present invention relates to a subsurface or mudline shutoff valve assembly adapted to be lowered through and installed internally of the extension casing leading from the wellhead at the mudline to the platform at the top of the water.

More particularly, the present invention involves a shutoff valve assembly, including one or more gate valves incorporated in a body for controlling fluid flow through one or more body passages, there being a shutoff valve or gate for each passage. Each shutoff valve or gate is held open by control fluid pressure supplied from a remote point. When control fluid pressure is bled off, for any reason, either purposely to close a passage or due to an accident or damage to equipment, resulting in the loss of control fluid pressure which can maintain the valve open, the valve is automatically closed.

An object of the invention is to provide subsurface shutoff valve apparatus, which can be run into the subsurface location through the usual conductor pipe or casing extension leading between the mudline wellhead equipment and a platform, and which is operable with certainty regardless of the nature of the emergency situation, fire accident, or the like, which may occur at the platform or above the mudline, resulting in the loss of control fluid pressure for holding the mudline valve apparatus open. Accordingly, the mudline valve apparatus has, as a further object, the provision of a valve apparatus with fluid pressure responsive fail-safe operating means which can be run within an extension pipe or casing of a diameter much smaller than the conventional subsurface christmas trees.

More specifically, each valve assembly of the invention includes fluid pressure or hydraulic pressure responsive actuator means to close its associated valve.

Hydraulic fluid is displaced from a valve operator piston chamber when the valve is opened, the displaced fluid flowing into a power cylinder and displacing a spring loaded piston to store valve closing energy. When the force holding the valve open is relieved, i.e., upon reduction in the control fluid pressure, the compressed spring or springs displace the piston in the power cylinder to force the hydraulic fluid to return to the operator piston chamber to act on the piston in the latter to force the valve to the closed position. In a preferred form, power fluid is also applicable to the power cylinder to augment the spring force, if necessary. Also, in a preferred form, an over-ride actuator is employed to close the valve if the automatic actuator fails. Such a hydraulic link valve operating means enables the assembly to be very compact.

This invention possesses many other advantages, and has other objects which may be made more clearly apparent from a consideration of illustrative forms in which it may be embodied. These forms are shown in the drawings accompanying and forming part of the present specification. They will now be described in detail, for the purpose of illustrating the general principles of the invention; but it is to be understood that such detailed description is not to be taken in a limiting sense.

Referring to the drawings:

FIG. 1 is an elevation showing a typical offshore well drilling and producing platform, with an extension casing interconnected between the usual christmas tree on the platform and the subsurface well head equipment;

FIGS. 2*a* through 2*d* together constitute a vertical section, as taken on the line 2—2 of FIG. 1, with certain of the parts shown in elevation, showing the mudline christmas tree installed in the casing hanger, FIGS. 2*b* through 2*d* being, respectively, successive downward continuations of FIG. 2*a;*

FIG. 3 is a horizontal section, as taken on the line 3—3 of FIG. 2a;

Figure 1:
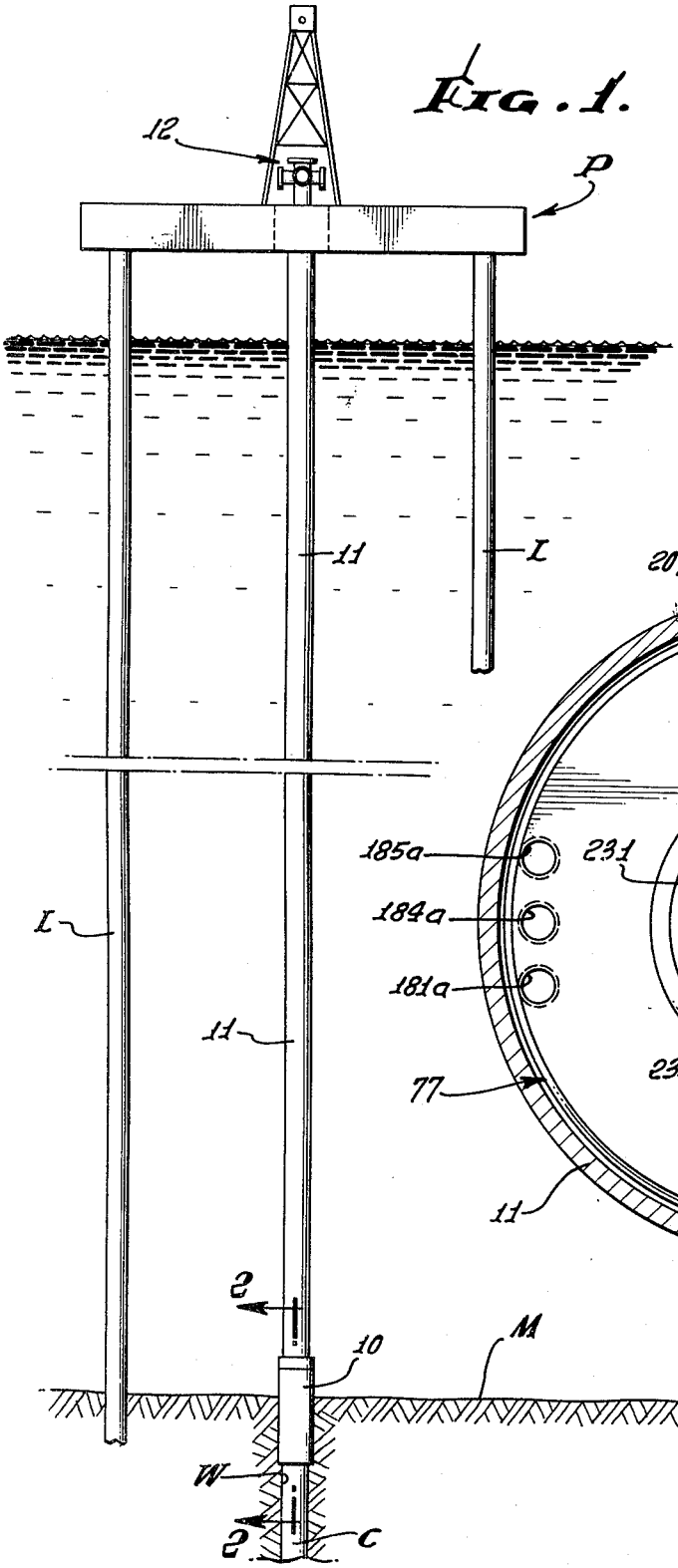

As seen in the drawings, with reference first to FIG. 1, a platform P is supported on legs or pilings L which extend downwardly through a body of water and into the earth at the so-called mudline M. From the platform P, a well W has been drilled into the earth and an outer string of casing C has been set in the well W and, as will be later described, inner casing strings are suspended from subsurface or mudline wellhead apparatus including a housing 10. A casing extension or conductor pipe extention 11 extends upwardly from the housing 10 to a typical christmas tree 12 through which the flow of well fluids is controlled by the usual christmas tree valves, as is well known. All of the well drilling, completion, and production procedures are conducted through the conductor pipe or casing 11, the housing 10 and the outer well casing C, including the running of successive inner strings of well casing into smaller diameter well bores, cementing the inner casing strings in the well, perforating the casing, treating and testing the formation and the production from one or more subsurface well zones.

Referring to FIGS. 2*a* through 2*d*, it will be seen that the conductor pipe extension or casing 11 is threadedly connected at 13 to a coupling 14, which has a radial shoulder 15 seating on the upper end of the housing 10 and a skirt 16 which extends downwardly into and is threadedly connected at 17 internally of the upper end of the housing 10. Between the skirt 16 of the coupling 14 and the housing 10 is a side ring seal 18. The outer well casing C is threadedly connected at 19 to the lower end of the housing 10.

The housing 10 is adapted to receive and support casing hanger means 20 for a first inner string of casing C1, which is adapted to extend downwardly through the outer casing C into the well bore. The casing hanger 20 includes a tubular body 21, to the lower end of which the casing string C1 is connected, as at the threaded joint 22. A split, resiliently expansible hanger ring 23 is disposed about the body 21 and is longitudinally confined between upper and lower retainer rings 24, 25 which are threaded on the body. Within the retainer rings 24 and 25, the body is vertically slotted at 26 and 27 to allow the fluid within the well to be upwardly displaced by cement as the casing string C1 is being cemented in place. On the outer periphery of the split hanger ring 23, it has a circumferentially extended groove 28 defined between a downwardly and outwardly sloping upper shoulder 29 and a lower, downwardly and outwardly sloping shoulder 30. Internally, the housing 10 has a circumferentially extended flange having an upper, outwardly and upwardly sloping shoulder 31, above which is a circumferentially extended groove 32 and below which is a circumferentially extended groove 33, these grooves being adapted to receive portions 34 and 35, respectively, of the hanger ring 23 when the hanger body is lowered to a position at which the ring 23 is expansible, so that the hanger ring shoulder 29 engages the housing shoulder 31 to support or hang the casing C1 in the well. The outer profile of the hanger ring 23 is such that the portions 34 and 35 of the lock ring engage opposing portions of the pipe 11, the coupling 14, and the housing 10 and prevent expansion of the hanger ring 23, except when the ring 23 is expansible into the grooves 32 and 33.

As is well known with casing hangers, such as the hanger 20, the hanger body 21 at its upper end has a bore 36 having an internal left-hand thread 37 adapted to receive a complementally threaded portion of a running tool (not shown), so that the casing string C1 and the hanger 20 can be lowered into the housing, to the position shown, and the running tool then removed. As the drilling of the well progresses, successively smaller strings of casing are similarly run in and cemented in the well bore. Thus, in the illustrated structure, a casing hanger 40 supports a second inner string of casing C2 within the body 21 of the hanger 20. The hanger 40 has an expansible, resilient hanger ring 41 which is engageable with a shoulder 42 in the hanger body 21, like the hanger ring 23 previously described, when the hanger 40 is lowered by a running tool engaged with the internally threaded upper end of the hanger 40.

A third inner string of casing C3 is shown in the illustrated structure as being supported by an inner casing hanger 43 which, like the casing hangers previously described, has an expansible, resilient hanger ring 44 engageable with the hanger shoulder 45 provided within the hanger 40. The upwardly extending portion 46 of the casing hanger 43 has the usual internal thread 47 adapted to receive a running tool (not shown) by which the inner casing string C3 and the hanger 43 may be run into the well, and, after recovery of the just-mentioned running tool and completion of the usual cementing, perforating and testing operations, a tubing hanger 48 having a tubular outer body or sleeve 49 is run into the casing hanger 43. The tubing hanger body 49 has an external thread 50 engageable with the internal thread 47 on the upper portion 46 of the hanger 43, and an outwardly extending shoulder 51 on the body tubing hanger 49 seats on the upper end of the portion 46 of the casing hanger 43. A suitable seal 52 is provided between the casing hanger portion 46 and the tubing hanger body 49. At the upper end of the tubing hanger body 49, it has an internal thread 53 for receiving a running tool (not shown). Within the outer tubing hanger body or sleeve 49 is an inner tubing hanger body 54 having an upper body section 55 disposed within the larger diameter upper portion of the outer body 49, and a reduced diameter portion 56 of the inner body 54 is disposed within the reduced diameter lower portion of the outer body 49.

At the lower end of the inner tubing hanger body 54, which extends below the lower end of the outer sleeve 49, is a cup member 57 of enlarged diameter which is threaded at 58 onto the lower end of the inner body 54. The cup 57 has a lower landing surface or outwardly projecting shoulder 59 adapted to land on the landing shoulder 60 within the body portion 46 of the casing hanger 43.

Figure 2A:
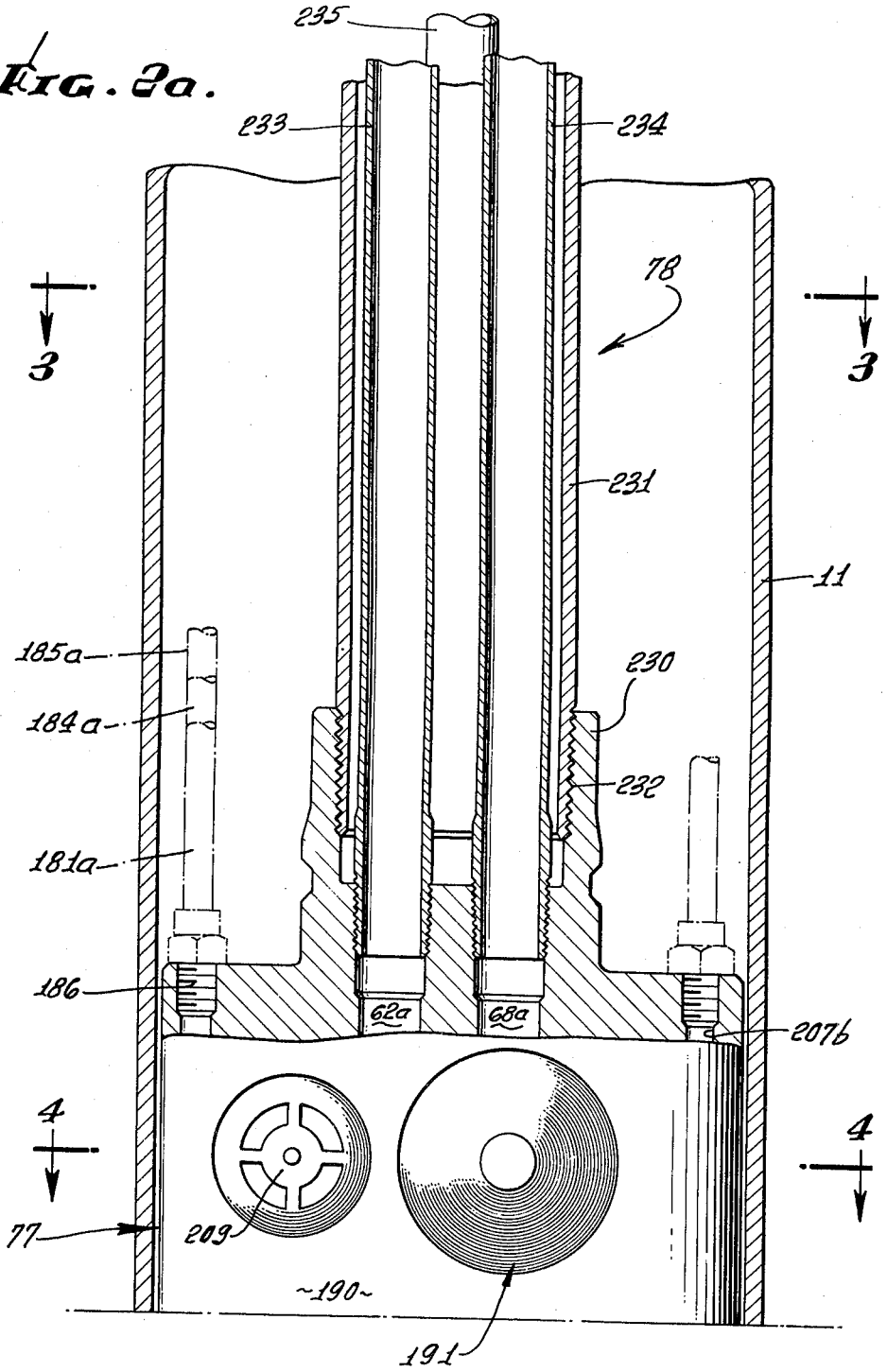
Figure 2B:
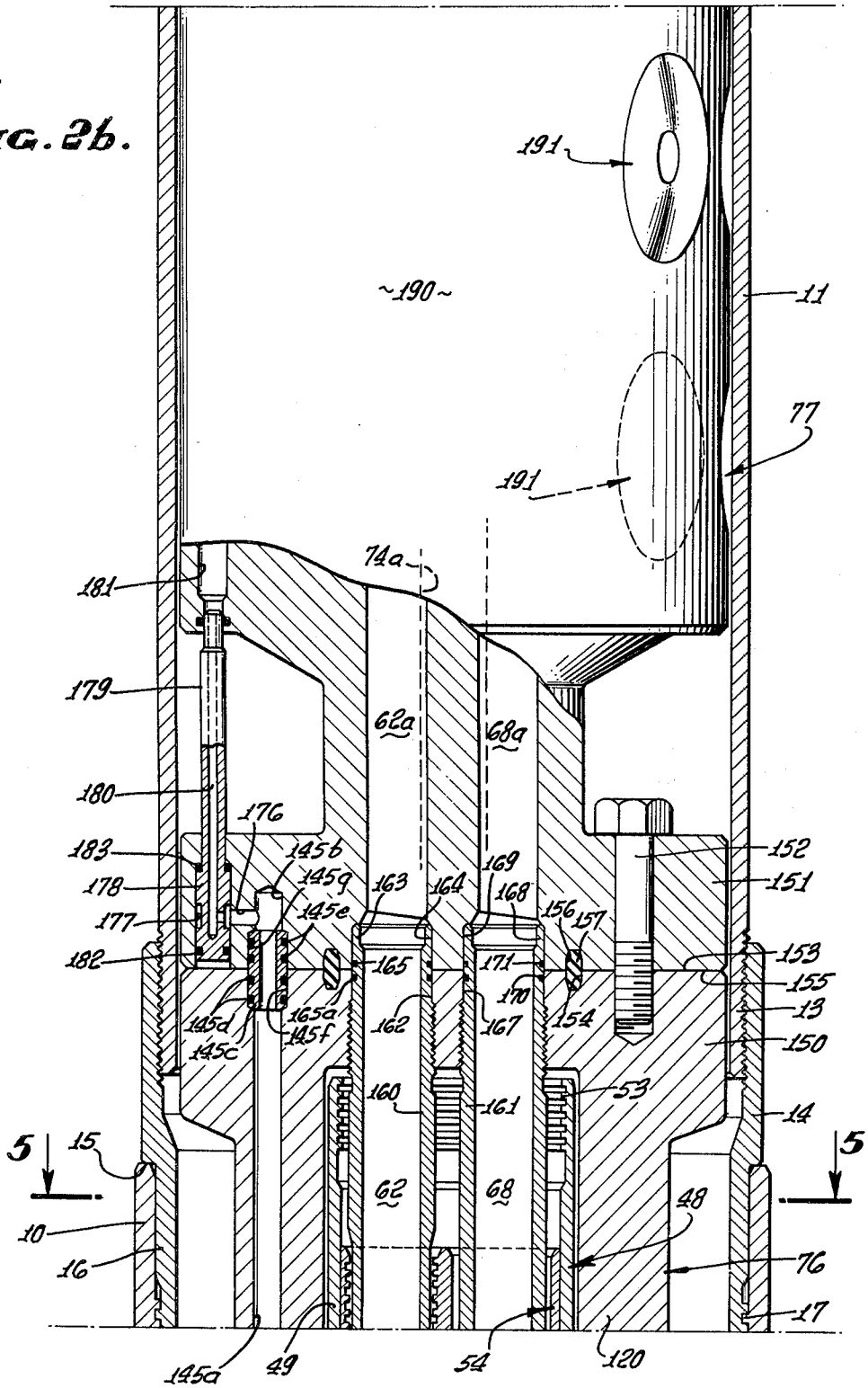
Figure 2C:
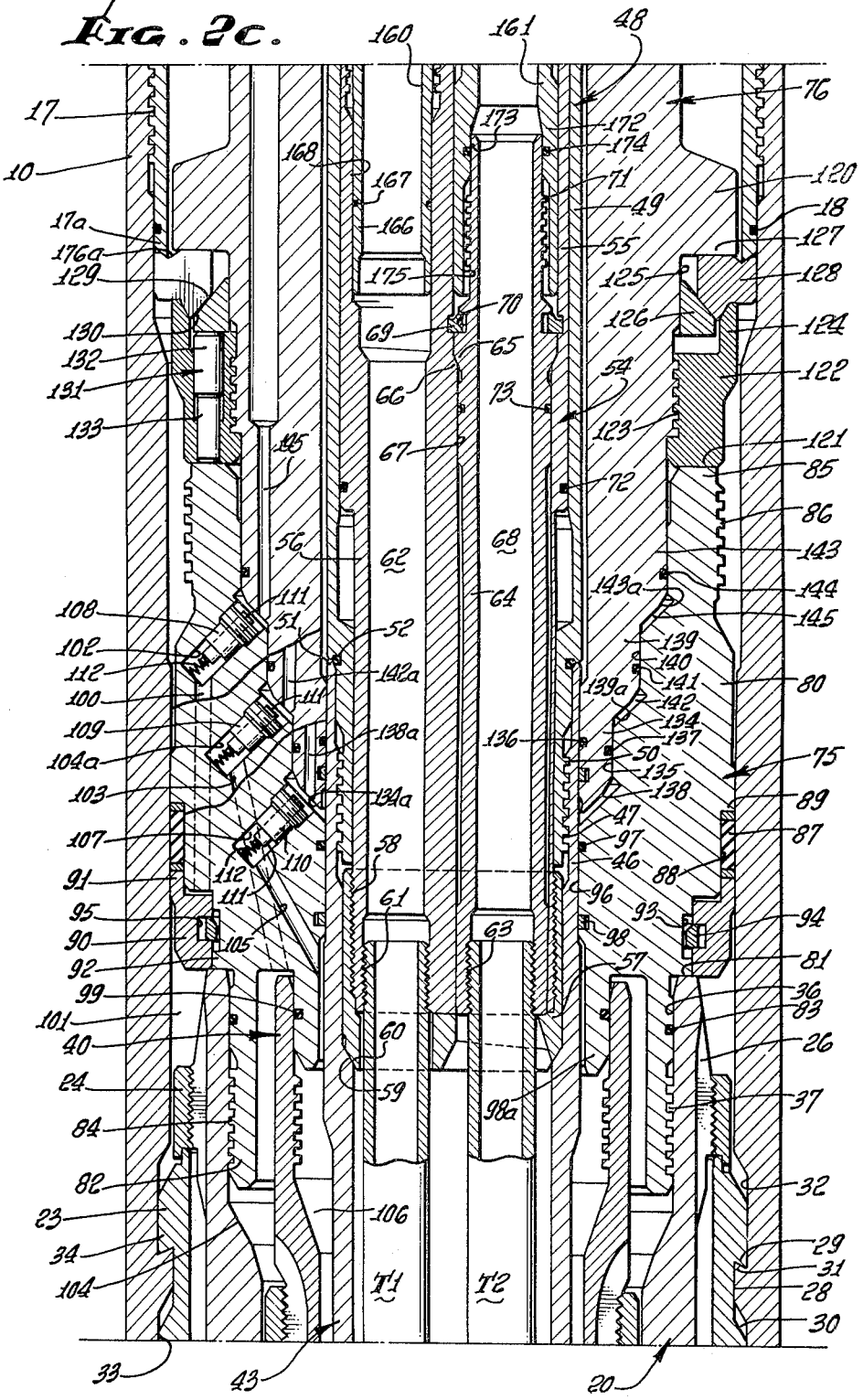
Figure 2D:
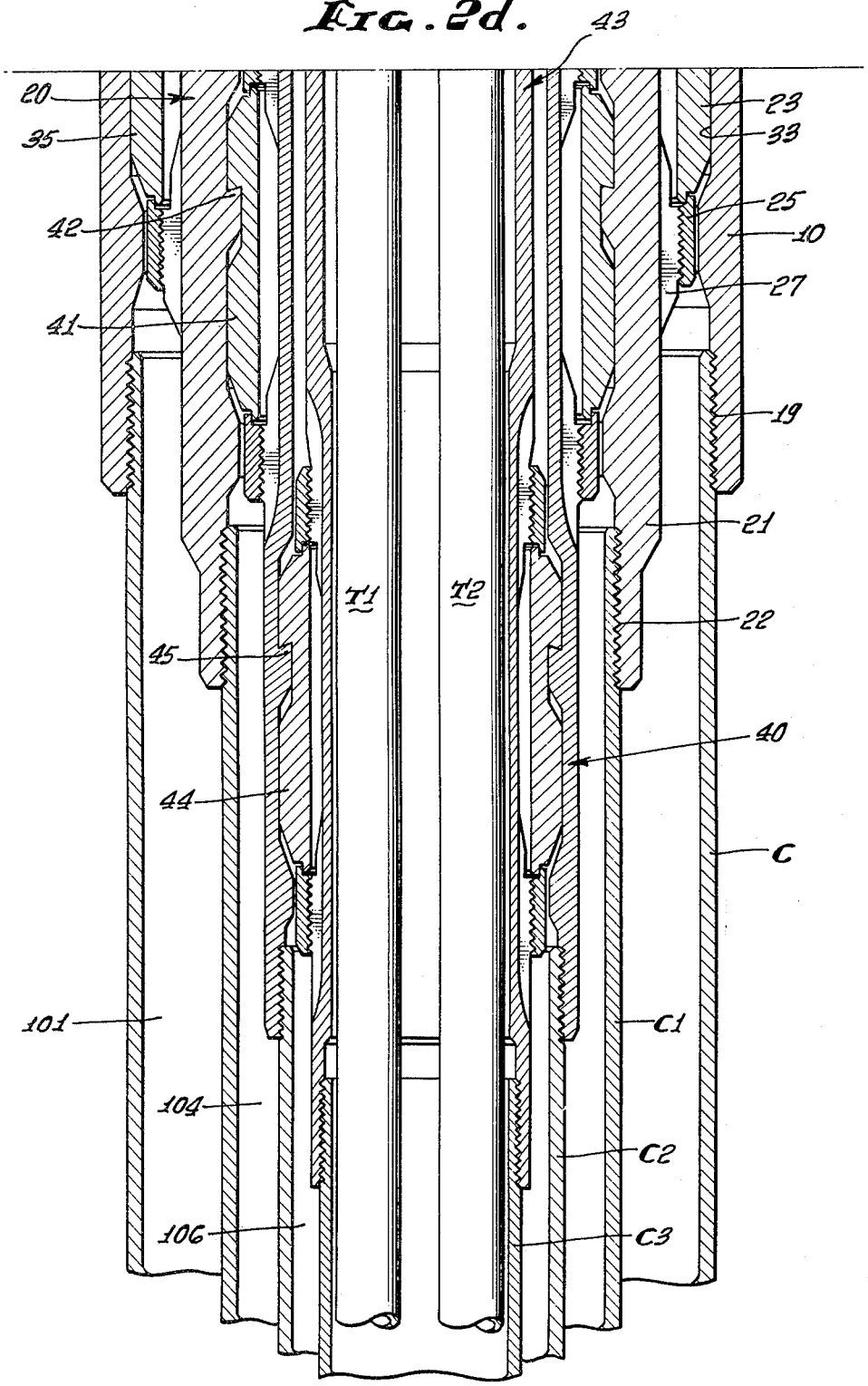

As is well known, such tubing hangers are adapted to support a number of tubing strings and to provide flow passages for the various producing well zones, and the various tubing strings may be run in different manners. In the present illustration, as seen in FIG. 2c, one tubing string T1 is threaded at its upper end 61 into a threaded bore of the inner body 54 and establishes communication from one well zone to a flow passage 62 extending longitudinally through the body 54. The tubing string T1, thus, is run into the well casing C3 on the tubing hanger 48. In addition, the tubing hanger 48 supports a second tubing string T2. This tubing string T2 is threaded at its upper end 63 into the lower end of a tubular tubing hanger mandrel 64 having an outwardly projecting landing shoulder 65 adapted to land on an internal shoulder 66 provided in a bore 67 which extends longitudinally through the inner tubing hanger body 54. Thus, the tubing T2 is suspended in the well casing C3 and establishes communication between a second well zone and a flow passage 68, which extends longitudinally through the hanger assembly. The tubing mandrel 64 is adapted to be locked down in the inner tubing hanger body 54 by means of a split, expansible, resilient latch ring 69 carried in a circumferential groove 70 in the mandrel 64 above the shoulder 65 and below an externally threaded running neck 71, which is adapted to receive a running tool (not shown). As is well known, such running tools are adapted to hold the lock ring 69 in an initially contracted condition in the groove 70, but when the running tool is removed, after landing of the tubing mandrel 64 on the body shoulder 66, the lock ring 69 is released to expand to the illustrated locking position.

Figure 5:
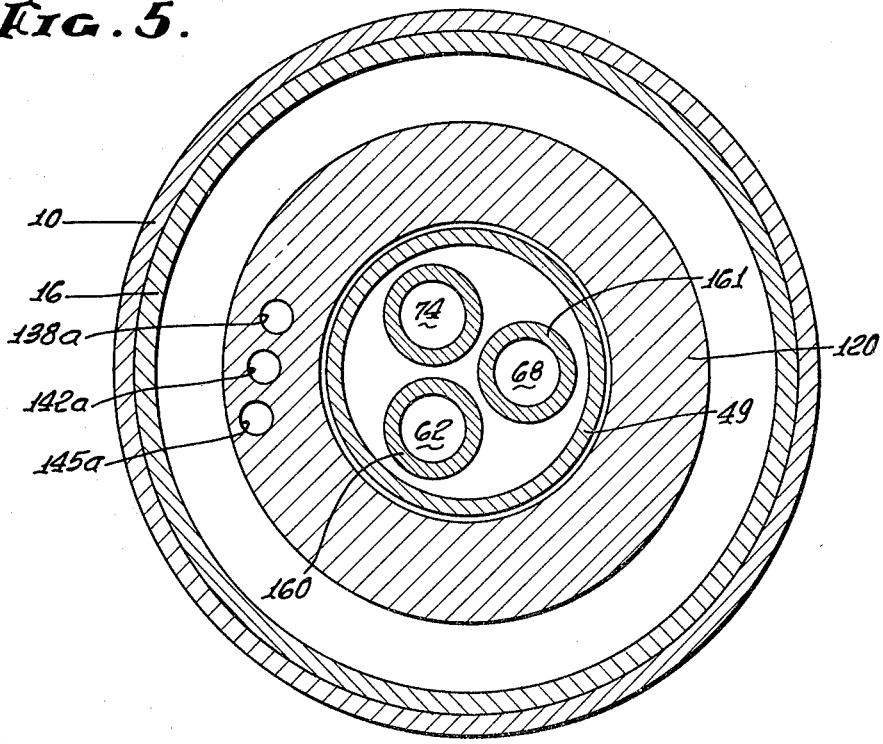
FIG. 5 is a horizontal section, as taken on the line 5—5 of FIG. 2*b;*

For the purpose of providing a seal between the inner tubing hanger body 54 and the outer body or sleeve 49, a suitable side ring seal 72 is interposed therebetween. Another side ring seal 73 is interposed between the tubing mandrel 64 and the body 54 in the bore 67. Thus, well fluids in the respective tubings T1 and T2 are confined to the flow passages 62 and 68. Well fluids from a third well zone are confined to the casing C3 and would flow through another flow passage 74 through the tubing hanger 48 (see FIG. 5), as is well known in the case of subsurface wellhead apparatus used in producing well fluids from three zones through three separate flow paths.

In this connection, the wellhead apparatus comprising the various casing hangers and the tubing hanger, as thus far described, is all of a known type and is illustrative of the subsurface structure to which the present mudline shutoff valve apparatus is applicable.

The preferred shutoff apparatus of the invention comprises intermediate means 75 for providing a seal isolating the various annular clearances between the casing hangers and the respective casings, C, C1, C2 and C3, such means 75 also providing a landing seat for connector means 76 which are adapted to be lowered into the housing 10 and to connect the flow passages in the subsurface wellhead apparatus with corresponding passages through the mudline valve means 77 and extension means 78 for connecting the mudline valve and its passages with the surface equipment or christmas tree 12 on the platform.

The intermediate means 75 comprises a body 80 of annular form having a lower, outer shoulder 81 adapted to abut with the upper end of the body 21 of the outer casing hanger 20. Depending from the bottom of the body 80 is an annular outer, sealing and anchoring skirt or flange 82 having an outer side ring seal 83 engageable within the inner surface 36 of the upper end of the casing hanger body 21. The skirt 82 has an external thread 84 engageable in the casing hanger body thread 37. At its upper end, the body 80 has a running neck 85 provided with an external thread 86 engageable by a running tool (not shown) by which the body 80 is adapted to be lowered through the conductor pipe extension 11 and threaded into the upper end of the casing hanger body 21, the running tool being removed when the body 80 is tightly engaged at its shoulder 81 with the hanger body 21.

Packing means are provided for effecting a seal between the housing 10 and the outer periphery of the body 80. This packing means comprises an elastomeric ring 87 disposed about an outer cylindrical wall 88 of the body 80 below a downwardly facing shoulder 89. A setting ring 90 has an upstanding annular flange 91 surrounding the wall 88 and opposed to the shoulder 89. The setting ring 90 extends about and is axially shiftable on a cylindrical section 92 of the body 80. This body section 92 has an outwardly opening groove 93 which receives the inner periphery of a split retainer ring 94, which is expansible outwardly into a ring carrying inner groove 95 in the setting ring 90 upon endwise assembly of the setting ring 90 over the lower end of the body section 92, the retainer ring 94 then expanding into the body groove 93 to prevent the setting ring from dropping off of the body section 92. When the setting ring abuts with the upper end of the casing hanger body 21, the setting ring is forced upwardly with respect to the body 80 so that the elastomeric seal ring 87 is axially and radially deformed into sealing engagement with the body wall 88 and the opposing inner wall of the housing 10.

Centrally of the body 80 is a bore 96 for receiving the upper end portion 46 of the casing hanger 43, the body 80 having suitable side ring seals 97, 98 engageable with the casing hanger portion 46. Depending from the intermediate body 80 and spaced radially inwardly from the sealing and anchoring skirt 82 is another sealing skirt 98*a* which extends downwardly into the upper portion of the casing hanger 40. Another side ring seal 99 is provided between the skirt and the opposing wall of the casing hanger 40. Thus, the intermediate member provides a means for sealing engagement with the housing 10 and the three casing hangers 20, 40 and 43, which isolate the various annular spaces between the housing and the casing hangers.

In this embodiment of the invention, the body 80 has a port 100 leading from the annular space 101 between the outer casing C and the first inner casing string C1 to a valve chamber 102 in the intermediate body 80. A port 103 leads from the annular space 104 between the casing C1 and the second inner string of casing C2 to another valve chamber 104*a* in the intermediate body 80. A further port 105 leads from the annular space 106 between the casing C2 and the inner string of casing C3 to a further valve chamber 107 in the intermediate body. In the respective valve chambers 102, 104*a* and 107 are normally closed poppet valve assemblies respectively designated 108, 109 and 110. Each valve assembly 108, 109 and 110 has a valve stem 111 adapted to be shifted to a normally closed position by a spring 112, so that when the connector means 76 is not in position, as shown, as will be later described, the valves 108, 109 and 110 prevent communication between the various annular spaces below the sealing means or intermediate member 80 and the conductor pipe extension 11 above the body 80. At such time, moreover, tubing plugs (not shown) could be employed to close off communication through the tubing hanger 48 between the productive well zones and the conductor pipe extension 11. These normally closed valves 108, 109 and 110 enable pressure testing after the intermediate member 80 has been set in place in the housing 10, but before removal of the running tool from the neck 85.

The connector means 76 more specifically comprises an annular elongated body 120 adapted to be landed in the intermediate body member 80 on the upper end of the running neck 85 of the body or intermediate member 80. Thus, the connector body 120 has a landing flange or shoulder 121 provided on a collar 122 which is threaded at 123 onto the body 120. Extending upwardly from the collar 122 is an outer, annular flange 124 spaced outwardly from the outer wall 125 of the body 120 to accommodate an annular wedge ring 126 therebetween. Interposed between the wedge ring 126 and a downwardly facing shoulder 127 provided on the body 120 is a normally contracted, resilient latch ring 128, or, if preferred, latch dogs may be employed, as is well known. The wedge ring 126 has an upper inclined surface 129 engageable with a lower inclined surface 130 on the latch ring 128 for causing outward expansion of the lock ring 128 in response to upward movement of the wedge ring 126. In order to effect such upward movement of the wedge ring 126, a suitable number of push rods 131 are carried by the landing collar 122 in angularly spaced relation, the push rods having enlarged upper ends 132 vertically reciprocable in bores in the landing collar 122 and having reduced lower ends 133 which normally depend through reduced bores in the collar 122, so as to engage the upper end of the running neck 85 on the intermediate body 80 as the connector 76 is being lowered into place. Contact of the lower ends 133 of the push rods 131 with the running neck 85 will push the rods 131 upwardly, correspondingly pushing the wedge ring 126 upwardly to wedge the latch dogs or ring 128 outwardly. During running of the connector means, as will be later described, the threaded connection 17 between the coupling 14 and the housing 10 is normally not made up tight, so that one or more turns of the conductor extension 11 is necessary to shoulder the coupling 14 on the housing 10, as seen at 15. However, when the connector means 76 has been landed and the latch ring 128 expanded, as just described, the conductor extension 11 is rotated to finally make up the threaded connection 17 and to dispose the lower end 17*a* of the coupling sleeve 16 in a notch 176*a* in the upper, outer portion of the lock ring to positively hold the connector means 76 against upward movement until and unless the threaded connection 17 is backed off to allow retraction of the lock ring 128.

The body 120 of the connector means 76 has a lower reduced diameter, cylindrical end portion 134 which, when the body 120 is landed, extends downwardly into the annular space between the outside wall of the upper neck portion 46 of the casing hanger 43 and an opposing cylindrical wall 135 of a first counterbore in the intermediate body 80. An inner side ring seal 136 and an outer side ring seal 137 are carried by the end portion 134 of the body 120 and engage the opposing walls of the casing hanger portion 46 and the intermediate body 80, thereby cooperating with the seal 97 therebelow to confine fluid in an annular chamber 138 into which fluid from the annular space 106 passes through the poppet valve 110 when the latter is open, as shown by engagement of the lower end face 134*a* of the body portion 134 with the valve stem. An intermediate cylindrical portion 139 of the body 120 has an enlarged diameter to fit within a second, larger counterbore 140 in the intermediate body 80, the portion 139 having a side ring seal 141 engaged in the counterbore 140 and cooperating with the seal 137 therebelow to confine fluid in an annular chamber 142 defined by the bodies 80 and 120. Fluid is admitted to the chamber 142 through the poppet valve 109, from the annular space 104 between casings C1 and C2, when the intermediate body is landed and the lower end face 139a of the body portion 139 contacts the stem of the valve 109, as shown. Above the intermediate body portion 139, the connector body 120 has a further enlarged cylindrical portion 143 provided with a side ring seal 144 engageable in the running neck 85 of the intermediate body 80 and cooperating with the seal 141 on the body portion 139 to confine fluid in an annular chamber 145. Fluid is admitted to the chamber 145 from the annular space 101 between the casings C1 and C when the lower end face 143*a* of the body portion 143 engages the stem of valve 108.

Extending longitudinally of the connector body 120 are respective ports 138*a*, 142*a* and 145*a* leading from the chambers 138, 142 and 145, so that, as will later be described, pressure in the various annular spaces 101, 104 and 106 may be monitored at the platform to indicate any change in pressure in any of the annuli.

At its upper end, the body 120 of the connector means 76 has an attachment flange 150 to which a lower attachment flange 151 of the subsurface or mudline shutoff valve means 77 is connected by a number of circumferentially spaced fasteners 152. The top wall 153 of the body 120 has an annular, upwardly opening groove 154, and the opposing lower face 155 of the flange 151 has an opposing, downwardly opening annular groove 156. An annular seal 157 is disposed in the grooves 154 and 156 to seal off the central region of the connection between the mudline valve means 77 and the connector means 76.

Adapter means are provided within the region defined within the seal ring 157 to establish communication between the flow passages 62, 68 and 74 provided by the tubing hanger 48 and corresponding passages 62*a*, 68*a* and 74*a* which extend upwardly through the mudline valve means 77. Thus, adaptor tubes, two of which are designated 160 and 161, respectively, in FIGS. 2*b* and 2*c*, are employed to bridge the joint between the mudline valve means 77 and the connector means 76.

The adaptor tube 160 is engaged in a threaded bore 162 in the end of the body 150 and has an end portion 163 which extends into a bore 164 in the end 151 of the mudline valve means 77, bridging the meeting plane of the end faces 153 and 155. Side ring seals 165 and 165*a* carried by the end 163 of the adaptor tube 160 effect a seal within the respective bores 162 and 164. The adaptor tube 160 has a downward extension 166 provided with an external side ring seal 167 engageable in an enlarged bore 168 in the tubing hanger inner body 54, constituting an extension of the flow passage 62 in the latter.

The adaptor tube 161 is engaged in a threaded bore 167 in the end of the body 150 and has an end portion 168 which extends into a bore 169 in the end 151 of the mudline valve means 77, bridging the meeting plane of the end faces 153 and 155. Side ring seals 170 and 171 carried by the end portion 168 of the adaptor tube 161 effect a seal within the respective bores 167 and 169. The adaptor tube 161 has a downward extension 172 slidably engageable in the upper body portion 55 of the tubing hanger body 54, the extension 172 having a bore 173 in which is a side ring seal 174 externally engageable with the upper end of the running neck 71 of the tubing mandrel 64, and an enlarged end bore 175 in the extension 172 accommodates the thread on the running neck 71.

It will be understood, without need for further illustration or description, that an adaptor tube similar to the adaptor tube 160 is employed to establish a connection between the flow passage 74 in the tubing hanger body 54 and the passage 74a in the mudline valve means 77.

Means are also provided to establish a fluid connection at the ends 153 and 155 for passages 138*a*, 142*a* and 145*a* which, as previously indicated, extend through the connector body 120 from the respective chambers 138, 142 and 145, which are defined between the connector body 120 and the intermediate body 80. As seen in FIG. 2*b*, a fluid connection is provided between the passage 145*a* and a port 145*b* in the lower end flange 151 of the mudline valve means 77 through an insert sleeve 145*c* having suitable side ring seals 145*d* and 145*e*, which engage in aligned bores 145*f* and 145*g* in the respective end flanges 150 and 151. The port 145*b* communicates with a passage 176 which leads into a bore 177 formed in the end flange 151. Disposed in the bore 177 is a seal end 178 of a conduit 179. This conduit 179 has a passage 180 extending longitudinally therethrough and opening at its upper end into a further passage 181, which extends longitudinally through the mudline valve means 77. The seal end 178 of the conduit 179 has suitable ring seals 182 and 183 engageable in the bore 177. While only one conduit 179 is shown, it will be appreciated that similar connections are made between the other passages 138*a* and 142*a*, whereby fluid will find access to the other two passages 184 and 185 in the valve means 77, as seen in FIG. 4, and which extend through the mudline valve means 77 in parallel relation to the passage 181 and are connected at their upper ends, as at 186, with suitable conduits 181*a*, 184*a* and 185*a*, as seen in FIG. 2*a*, which are adapted to extend to the platform at the top of the water within the conductor pipe extension 11.

Figure 4:
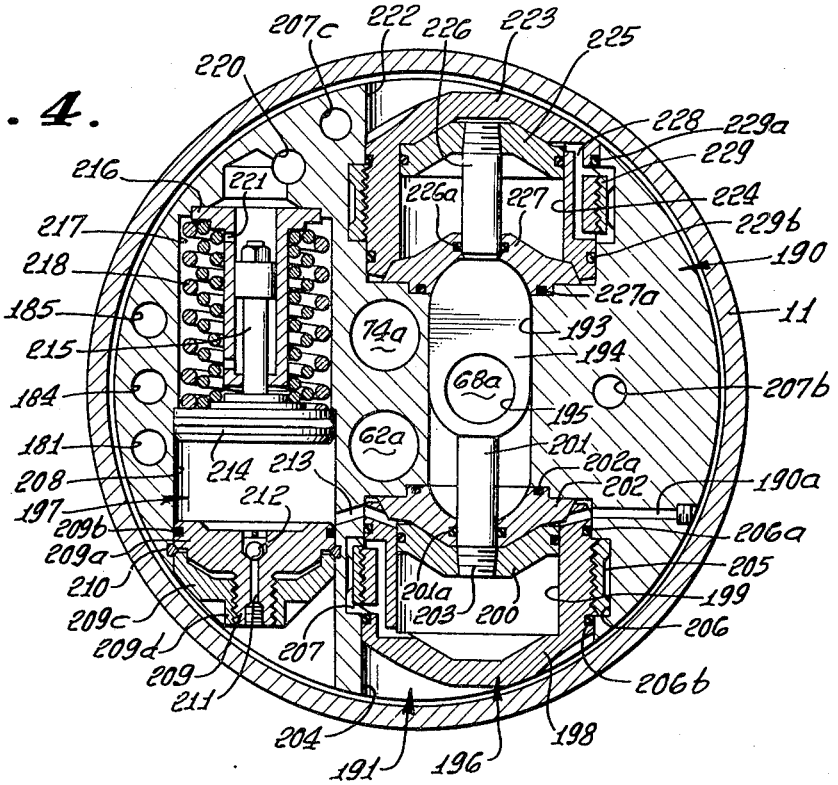
FIG. 4 is a horizontal section, as taken on the line 4—4 of FIG. 2*a*, showing a shutoff gate valve in an open condition.

The mudline valve means 77 is shown as comprising an elongated body 190 through which the passages 62*a*, 68*a* and 74*a* extend longitudinally from the tubing adaptor sleeves 160 and 161, as seen in FIGS. 2*b* and 4. Disposed at vertically spaced locations within the valve body 190 is a plurality of shutoff valve means 191, a respective one of which is shown in detail in FIG. 4. One of the valve means 191 is adapted to either permit or shut off flow through one of the passages 62*a*, 68*a* 74*a*.

More particularly, the valve means 191 comprises an elongated chamber 193 intersected by the passage 68*a* and in which a valve gate or slide 194 is reciprocable between the position shown in FIG. 4, at which the port 195 in the slide is aligned with the flow passage 68a in the body, and the alternate position at which the unported section of the slide will close the passage 68a through the body. Operating means are provided for the valve, so that the valve slide is normally maintained in the illustrated position to allow well fluids to flow upwardly through the flow passage in the body, but the valve slide is shifted to the alternate closed position in the event of an emergency, such as damage to the platform, loss of production fluid pressure, or other event. To accomplish this, the valve slide 194 is actuated to the open position by a fluid pressure responsive actuator device 196. Actuation of the slide to the open position displaces fluid from the actuator device 196 to power piston and cylinder means 197, which are adapted to return the valve slide to the closed position when the fluid pressure holding the slide in the open position is released.

More particularly, the actuator 196 comprises a cylinder 198 having a piston chamber 199 in which a piston 200 is reciprocable. A rod 201 connected to an end of the valve slide 194 is reciprocable through a cylinder head 202 having a rod seal 201*a*, and is connected at 203 to the piston 200 so that the piston, the rod and the slide are movable as a unit. A head seal 202*a* prevents communication between the valve chamber 93 and the chamber 199. The cylinder 198 is retained in a laterally opening bore 204 in the body 190 by a split, internally threaded ring 205, which seats in an annular groove 206 and forms passage means 207 between cylinder seals 206*a* and 206*b* for the flow of pressure fluid into and from the cylinder 198 at the outer side of the piston 200, the passage 207 being connected in a suitable manner with an inlet conduit 207*a* (FIG. 3) which extends to the platform for connection to a control pressure source, as is well known in the operation of existing well valves. The valve body 190 has other ports 207*b* and 207*c* for conducting control fluid to and from the other valves 191. In horizontally spaced offset relation to the actuator 196, the power piston and cylinder means 197 includes a bore or piston chamber 208 which has a composite head 209 secured therein by a split lock ring 210. An inner head portion 209*a* has a seal 209*b* in the bore 208, and a head retainer portion 209*c* is threaded on a stem 209*d*, so that the inner head portion and the retainer portion may be removably interengaged with the lock ring 210. The head 209 includes a suitable filler opening 211 having a back flow preventing valve 212 and a passage 213 establishing communication between the piston chamber 208 and the actuator piston chamber 199 at the inner side of the actuator piston 200. To bleed air from the hydraulic system, when it is being filled, the body 190 has a bleed port 190*a* communicating with the chamber 199 between the piston 200 and the head 202.

Reciprocable in the piston chamber 208 is a piston 214 having a rod 215 reciprocable in a spring seat and guide 216, which seats at the base of a spring chamber 217. In the spring chamber 217 are a number of coiled compression springs 218 which normally act to bias the piston 214 toward the head 209. However, when pressure fluid is applied through the port 207 to the piston chamber 199 to move the piston 200 and the valve slide 194 to the open position, as shown, fluid is displaced by piston 200 from the chamber 199 through the passage 213 into the piston chamber 208 and acts on the piston 214 to move it in a direction which compresses the springs 218. So long as the actuating fluid pressure is maintained in the actuator piston chamber 199 and overcomes the springs 218, then the valve slide 194 will remain in the open position, but, if for any reason actuator fluid pressure in the piston chamber 199 is exhausted, then the springs 218 will urge the piston toward the normal position to displace fluid back through the passage 213 into the actuator piston chamber 199, and the valve slide will be moved to its closed position.

Preferably, the valve apparatus includes means for positively assuring that the valve slide 194 will be shifted to the closed position upon the release of control fluid pressure from the actuator piston chamber 199, as a precaution against the valve remaining inadvertently open. In the embodiment now being described, the valve body 190 is provided with a supplemental pressure fluid port 220 communicating with the spring chamber 217 behind the piston 214. Pressure fluid applied through the port 220 can flow through suitable ports 221 in the piston guide and spring seat 216 to supplement the force of the spring 218, tending to displace fluid from the piston chamber 208 into the piston chamber 199 to move the valve slide to the closed position.

As a further safety measure, the valve may be positively closed even in the event of loss of fluid from the piston chamber 208 and 199. To accomplish this body 190 is bored at 222 to receive a cylinder 223 generally corresponding to the cylinder 198. Within the cylinder 223 is a piston chamber 224 having reciprocal therein a piston 225 carried on a rod 226, which extends through a rod seal 226a in a cylinder head 227 into engagement with the adjacent end of the valve slide 194. A head seal 227*a* prevents communication between the piston chamber 224 and the valve chamber 193. Pressure fluid may be admitted to the piston chamber 224 via passage means 228 provided in the cylinder 223 and in the mounting ring 229 between cylinder seals 229*a* and 229*b* engaged in the bore 222 of such passage means 228, being adapted to receive pressure fluid supplied from the platform. Thus, the valve slide 194 may be, if desired, positively actuated to the closed position.

Figure 3:
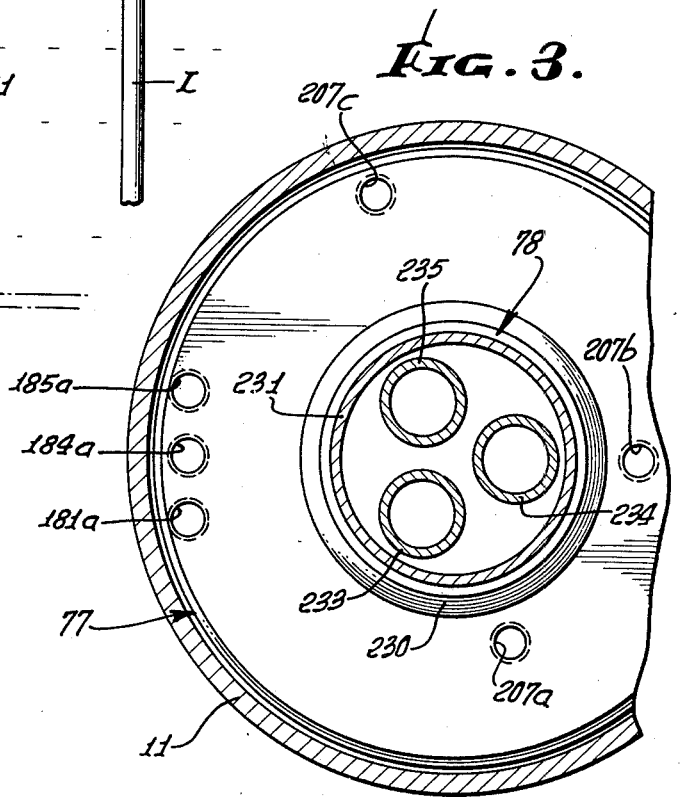

In the use of the subsurface apparatus, it will now be understood that when the tubing strings T1 and T2 are suspended in the well bore and the intermediate body member 80 has been landed and connected to the casing hanger 20, the interconnected valve body 190 and connector body 120 are, together, lowered in the conductor pipe extension 11. One manner of lowering or running the valve connector assembly and establishing communication between the passages 62*a*, 68*a* 74*a* through the valve body 190 and the surface christmas tree 12 is illustrated in FIGS. 2*a* and 3. In these views, the valve body 190 at its upper end has a running neck 230 to which a running string of casing 231 is threadedly connected at 232, this casing string constituting part of the extension means 78, previously referred to, which leads between the platform and the subsurface apparatus. Within the casing string 231 are respective tubing strings 233, 234 and 235 connected to the valve passages 62*a*, 68*a* and 74*a* for conducting production fluid from the well to the platform. The tubing strings 233, 234 and 235 are progressively made up and lowered through the conductor pipe extension 11 so as to be stabbed into and threadedly connected to the subsurface valve body, as at 62*b* and 68*b*. At the platform, the tubing strings 233, 234 and 235 are connected to the christmas tree 12, so that well production is controlled by the usual surface christmas tree, and the subsurface or mudline valve apparatus is operative in the event of any emergency which may result from loss of control fluid pressure supplied to the respective actuators of the subsurface valves 191. In this connection, it will be understood that control pressure conduits and monitoring conduits would be run in as the subsurface valve assembly is being lowered on the extension means 78.

Figure 6:
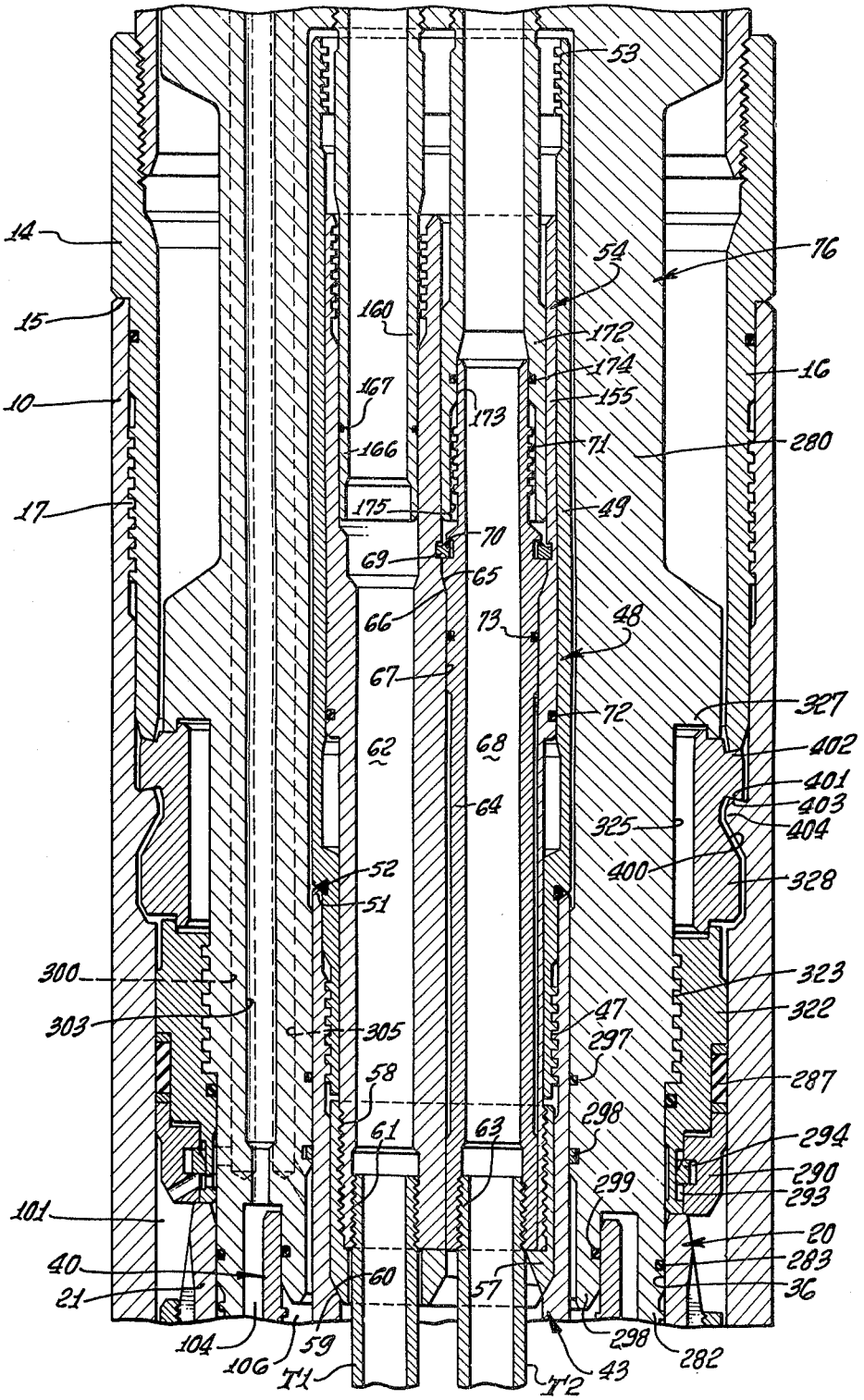
FIG. 6 is a view in vertical section generally corresponding to FIG. 2*c*, but showing a modified connector landed in the mudline casing hanger.

A modified structure is shown in FIG. 6, wherein the intermediate member 80 is eliminated and the connector means 76 includes means for effecting a seal between the various casing annuli 101, 104 and 106. In this illustration, the casing hangers 20, 40 and 43 and the tubing hanger 48 are the same as previously described. Here, however, the connector body 280 has a depending annular flange 282 providing a side ring seal 283 engageable within the cylindrical surface 36 within the upper end of the casing hanger body 21. In addition, the connector body 280 has an inner depending flange 298 which carries an external side ring seal 299 engageable within the upper end of the casing hanger 40. The connector body 280 also carries the intermediate side ring seals 297 and 298 which engage the outer surface of the casing hanger 43. Thus, the connector body 280, rather than an intermediate member, like the intermediate member 80 previously described, provides the necessary seal between the casing annuli. The connector body 280, moreover, if the casing annulus pressure is to be monitored, provides passages 300, 303 and 305 extending longitudinally of the connector body and connectible with the subsurface valve body, as previously described in respect to the monitoring fluid passages of the first embodiment, but there are no normally closed valves, such as the valves 108, 109 and 110, to allow pressure testing of the sealed casing annuli.

Externally, the connector body 280 has a latch ring retainer 322 threadedly connected at 323 to the body 280. In this case, the external elastomeric packing ring 287 and its actuating ring 290 are carried by the latch ring retainer 322. An external groove 293 in the retainer 322 receives the split ring 294 to maintain the actuator ring assembled on the retainer 322, but capable of axial movement to expand the packing 287 when the actuator ring 290 lands on the upper end of the casing hanger body 21.

In this embodiment, the latch ring 328 is resiliently expansible within an annular groove 325 defined between the upper end of the retainer 322 and a downwardly facing shoulder 327 on the body 280. The latch ring 328 has an external profile comprising an annular groove 400 and a downwardly facing shoulder 401, there being an upper shoulder 402 on the latch ring 328. This profile is such that the latch ring 328 will expand outwardly upon being lowered through the coupling 14, and when opposed by the companion profile of the housing 10, which includes the inwardly and upwardly sloping upper face 403 of an annular rib 404. As in the previously described embodiment, the coupling 14 is similarly made up tight after the body 280 has been landed so that the final turning of the coupling 14 on the thread 17 moves the lower end of the coupling 14 into holding engagement with the upper shoulder 402 on the latch ring 328. Various other latch arrangements may also be employed, as are well known in the art.

Figure 8:
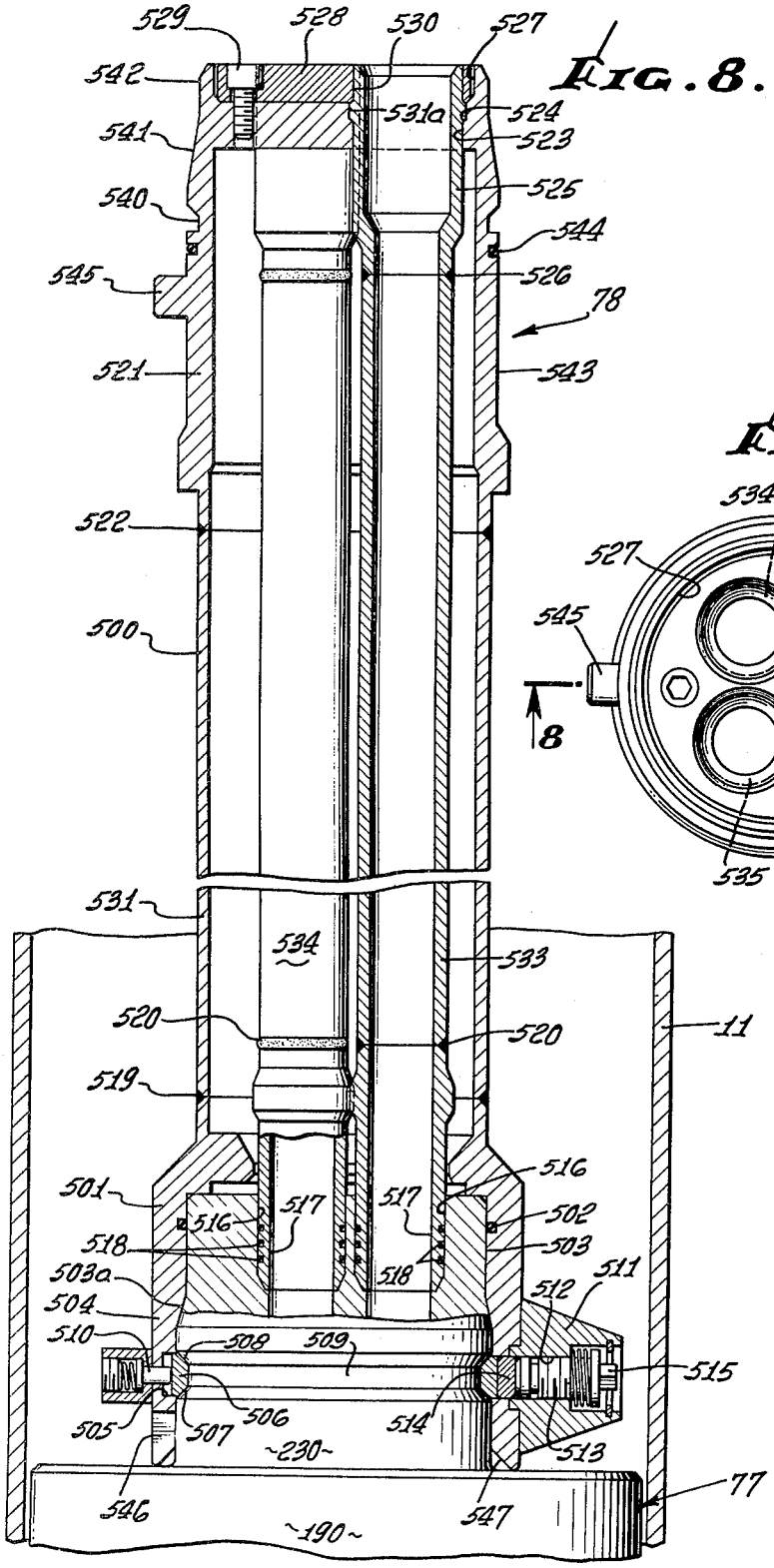
FIG. 8 is a vertical section as taken on the line 8—8 of FIG. 7.
Figure 7:
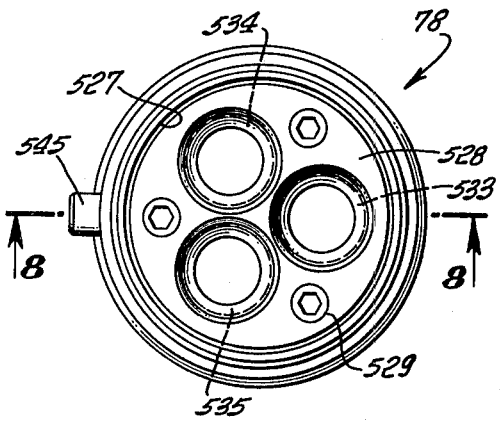
FIG. 7 is a top plan of a riser joint employed to provide the extension means from the subsurface apparatus to the platform.

Referring to FIGS. 7 and 8, a modified extension means 78 is shown. In accordance with this feature of the invention, the extension means is adapted to be made up of a suitable number of riser joints 500 so constructed that each joint is connectible endwise to another joint to provide all of the necessary tubular conduits, including the outer casing 531 and the various inner strings of tubing, such as the tubing strings 533, 534 and 535. Each joint 500, at its lower end, has a downwardly opening box 501 adapted to either fit upon the upstanding neck 230 of the subsurface valve body 190 or to mate with another joint, as will be described below. A suitable side ring seal 502 is carried internally of the box 501 and engages with the outer cylindrical wall 503 of the neck 230 above an outwardly tapered section 503*a*. The skirt 504 of the box 501 has an internal annular groove 505 in which is disposed a split, resilient lock ring 506 having an upwardly and inwardly inclined wall 507 and a downwardly and inwardly inclined upper wall 508, whereby the ring 506 is expansible over the upper end of the valve body neck 230 and engageable in a correspondingly formed groove 509 extending circumferentially in the outer body wall of the valve body neck 230 below the tapered section 503*a*. Disposed about the box 501 is a suitable number of spring-loaded plungers 510, the inner ends of which extend into the grooves 505 and engage the outer periphery of the lock ring 506 to bias the ring inwardly. In addition, the box 501 carries a suitable number of bosses 511 threaded at 512 to receive a radially shiftable ring-deforming screw 513, the inner end of which engages a pad 514 so that the screw may be rotated by engagement of a tool receiving end 515 with an appropriate turning tool to positively force the lock ring 506 into the groove 509. Such ring connectors are well known.

In this embodiment, the upper end of the valve body neck 230 is provided with sockets 516 to receive the lower ends of tubing stabbing subs 517, which are provided with suitable side ring seals 518 engageable with the walls of the sockets 516. The outer casing 531 is welded at 519, or otherwise affixed to the box 501, and the inner tubings 533, 534 and 535 are welded, as at 520, or otherwise connected to the stabbing subs 517. The casing 531 and the respective tubings 533, 534 and 535 may be of any convenient length to provide a joint 500 which can be conveniently handled.

At its upper end, the casing 531 has a tubular pin member 521 welded at 522, or otherwise affixed to the casing. Internally, the pin member 521 has sockets 523 providing upwardly facing shoulders 524 adapted to receive tubing sub receptacles 525, to each of which one of the tubings 533, 534 and 535 is welded at 526, or otherwise secured. In a recess 527 in the top of the pin member 521, a circular retainer plate 528 is retained by suitable fasteners 529, the plate having openings 530 for the upper ends of the receptacles 525, and the plate engaging peripheral ribs 531a on the receptacles 525 to hold the receptacles in place on the shoulders 524.

Externally, the pin member 521 has a configuration conforming to the internal configuration of the box member 501, previously described, so that an extension joint 500 is readily connectible to a similar extension joint by inserting a pin end 521 into a box end 501. Thus, included on the exterior of the pin 521 is an outwardly opening annular groove 540 adapted to receive a lock ring 506 of a companion box 501 upon interconnection of the extension joints. Above the groove 540, the pin 521 has a tapered section corresponding to the section 503*a* of the valve neck 231, and above the section 541 is a cylindrical section 542 for sealing engagement by the ring seal 502 of a box 501. Below the groove 540, the pin 521 has a further cylindrical section 543 provided with a side ring seal 544 engageable with a companion surface in the box 501.

The joints 500 must be oriented so that the stabbing subs 517 of one joint will stab into the receptacles 525 of another joint when the joints are being interconnected. Accordingly, the pin member 521 is provided with a radially outwardly projecting key 545 adapted to slide into a keyway or slot 546, which extends longitudinally in one side of the skirt portion 504 of the box 501. At all other locations, the key 545 will engage the downwardly and outwardly flared lower face 547 of the box member 501, so that the pin and box cannot telescopically coengage until they are properly oriented and the key 545 is aligned with the keyway 546, at which time the stabbing subs 517 will be aligned with the receptacles 525.

Using the extension means of FIGS. 7 and 8, successive joints 500 may be joined with ease, eliminating the need for separately making up the various tubing and casing strings as previously described, as is apparent. The use of extension joints 500 also facilitates retrieval of the subsurface apparatus when necessary. It will also be apparent that all of the necessary monitoring conduits, control pressure conduits, and other necessary pressure lines may be conveniently incorporated in the joints 500. In addition, the joint pin ends 521 facilitate connection of the extension means 78 with the surface christmas tree 12.

I claim:

1. In fluid pressure operated control valve apparatus, valve body means providing a plurality of flow passages, shutoff valve means for each of said passages including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one direction, passage means leading between the respective piston chambers at one side of each of said pistons, hydraulic fluid filling said piston chambers and said passage means between said pistons, whereby when said actuator piston is moved by control fluid pressure to move said valve gate from said second position to said first position, said power piston is moved in the other direction to store energy in said energy storing means for moving said power piston in said one direction and said valve gate to said first position when control fluid pressure is reduced, and fluid pressure actuated supplemental means for actuating said valve gate to said second position.

2. In fluid pressure operated control valve apparatus, valve body means providing a plurality of flow passages, shutoff valve means for each of said passages including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one direction, passage means leading between the respective piston chambers at one side of said pistons, hydraulic fluid filling said piston chambers and said passage means between said pistons, whereby when said actuator piston is moved by control fluid pressure to move said valve gate from said second position to said first position, said power piston is moved in the other direction to store energy storing means for moving said power piston in said one direction and said valve gate to said first position when control fluid pressure is reduced, supplemental means for actuating said valve gate to said second position including means for supplying pressure fluid to said piston chamber in which said power piston is reciprocable to augment said energy storing means.

3. In fluid pressure operated control valve apparatus, valve body means providing a plurality of flow passages, shutoff valve means for each of said passages including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one direction, passage means leading between the respective piston chambers at one side of each of said pistons, hydraulic fluid filling said piston chambers and said passage means between said pistons, whereby when said actuator piston is moved by control fluid pressure to move said valve gate from said second position to said first position, said power piston is moved in the other direction to store energy in said energy storing means for moving said power piston in said one direction and said valve gate to said first position when control fluid pressure is reduced, supplemental means for actuating said valve gate to said second position including an override piston, a piston a chamber in which said override piston is reciprocable, said override piston engaging said valve gate to move the latter to its second position, and means for supplying pressure fluid to said override piston chamber.

4. In fluid pressure operated control valve apparatus, valve body means providing a flow passage, shutoff valve means for said passage including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one direction, passage means leading between the respective piston chambers at one side of each of said pistons, hydraulic fluid filling said piston chambers and said passage means between said pistons, whereby when said actuator piston is moved by control fluid pressure to move said valve gate from said second position to said first position, said power piston is moved in the other direction to store energy in said energy storing means for moving said power piston in said one direction and said valve gate to said first position when control fluid pressure is reduced, and fluid pressure actuated supplemental means for actuating said valve gate to said second position.

5. In fluid pressure operated control valve apparatus as defined in claim 4, said energy storing means including one or more springs engaging said power piston.

6. In fluid pressure operated control valve apparatus, valve body means providing a flow passage, shutoff valve means for said passage including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one direction, passage means leading between the respective piston chambers at one side of each of said pistons, hydraulic fluid filling said piston chambers and said passage means between said pistons, whereby when said actuator piston is moved by control fluid pressure to move said valve gate from said second position to said first position, said power piston is moved in the other direction to store energy in said energy storing means for moving said power piston in said one direction and said valve gate to said first position when control fluid pressure is reduced, supplemental means for actuating said valve gate to said second position including means for supplying pressure fluid to said piston chamber in which said power piston is reciprocable to augment said energy storing means.

7. In fluid pressure operated control valve apparatus as defined in claim 6, said energy storing means including one or more springs engaging said power piston.

8. In fluid pressure operated control valve apparatus, valve body means providing a flow passage, shutoff valve means for said pressure including a valve member shiftable between a first position at which said passage is open and a second position at which said passage is closed, control fluid pressure operated means for holding said valve member in said first position, and means for moving said valve member to said second position, said shutoff valve means comprising a valve chamber intersected by said passage, a valve gate slidable in said chamber between said first and second positions, said control fluid pressure operated means comprising an actuator piston connected with said valve gate, a piston chamber in which said actuator piston is reciprocable, said means for moving said valve gate to said second position including a power piston, a piston chamber in which said power piston is reciprocable, energy storing means normally urging said power piston in one directon, passage means leading between the respective piston chambers at one side of each of said pistons, hydraulic fluid filling said piston chambers and said passage means between said pistons, whereby when said actuator piston is moved by control fluid pressure to move said valve gate from said second position to said first position, said power piston is moved in the other direction to store energy in said energy storing means for moving said power piston in said one direction and said valve gate to said first position when control fluid pressure is reduced, supplemental means for actuating said valve gate to said second position including an override piston, a piston chamber in which said override piston is reciprocable, said override piston engaging said valve gate to moved the latter to its second position, and means for supplying pressure fluid to said override piston chamber.

9. In fluid pressure operated control valve apparatus as defined in claim 8, said energy storing means including one or more springs engaging said power piston.

* * * * *